US009598972B2

(12) United States Patent
Strock

(10) Patent No.: US 9,598,972 B2
(45) Date of Patent: Mar. 21, 2017

(54) ABRADABLE TURBINE AIR SEAL

(75) Inventor: Christopher W. Strock, Kennebunk, ME (US)

(73) Assignee: United Technologies Corporation, Farmington, CT (US)

( * ) Notice: Subject to any disclaimer, the term of this patent is extended or adjusted under 35 U.S.C. 154(b) by 2018 days.

(21) Appl. No.: 12/749,750

(22) Filed: Mar. 30, 2010

(65) Prior Publication Data

US 2011/0243715 A1 Oct. 6, 2011

(51) Int. Cl.
*F01D 11/12* (2006.01)

(52) U.S. Cl.
CPC ..... *F01D 11/122* (2013.01); *F05D 2300/43* (2013.01); *F05D 2300/514* (2013.01); *F05D 2300/612* (2013.01); *Y10T 29/4932* (2015.01)

(58) Field of Classification Search
USPC ..... 415/173.4, 174.4; 19/889.2; 29/889.2
See application file for complete search history.

(56) References Cited

U.S. PATENT DOCUMENTS 3,831,258 A * 8/1974 Elbert et al. ..... 428/592
3,897,221 A * 7/1975 Salyer et al. ..... 428/566
3,915,671 A * 10/1975 Kagawa ..... 51/296
4,566,700 A 1/1986 Shiembob
4,696,855 A 9/1987 Pettit, Jr. et al.
4,759,957 A * 7/1988 Eaton et al. ..... 427/226
4,783,341 A 11/1988 Packer et al.
4,938,784 A * 7/1990 Murakami et al. ..... 51/293
5,304,032 A 4/1994 Bosna et al.
5,350,557 A * 9/1994 Jarrabet et al. ..... 419/19
5,364,543 A 11/1994 Bosna et al.
5,370,718 A * 12/1994 Terazawa et al. ..... 51/295
5,388,959 A 2/1995 Forrester et al.
5,536,022 A 7/1996 Sileo et al.
5,780,116 A 7/1998 Sileo et al.
5,780,146 A 7/1998 Mason et al.
5,962,076 A 10/1999 Mason et al.
6,089,825 A 7/2000 Walden et al.
6,190,124 B1 2/2001 Freling et al.
6,352,264 B1 3/2002 Dalzell, Jr. et al.
6,410,159 B1 * 6/2002 Hermanek ..... 428/570
6,899,339 B2 * 5/2005 Sanders et al. ..... 277/415
7,052,527 B2 * 5/2006 Hajmrle et al. ..... 75/252
7,582,362 B2 * 9/2009 Fiala et al. ..... 428/674
7,955,049 B2 * 6/2011 Hopkins ..... 415/173.4
7,955,707 B2 * 6/2011 Xie et al. ..... 428/472
7,981,530 B2 * 7/2011 Sporer et al. ..... 428/701
8,017,240 B2 * 9/2011 Strock ..... 428/408

OTHER PUBLICATIONS

European Search Report for EP Application No. 11160305.6 dated Nov. 20, 2013.

* cited by examiner

*Primary Examiner* — Ninh H Nguyen
(74) *Attorney, Agent, or Firm* — Carlson, Gaskey & Olds, P.C.

(57) ABSTRACT

An abradable seal for a gas turbine engine includes a metal alloy and a plurality of pores in the metal alloy. The plurality of pores have a diameter of approximately 1 to 10 microns.

20 Claims, 3 Drawing Sheets

ABRADABLE TURBINE AIR SEAL

BACKGROUND OF THE INVENTION

This application relates generally to an abradable seal for use in a gas turbine engine to protect tips of compressor blades.

Gas turbine engines include compressor rotors including a plurality of rotating compressor blades. Minimizing the leakage of air between tips of the compressor blades and a casing of the gas turbine engine increases the efficiency of the gas turbine engine as the leakage of air over the tips of the compressor blades can cause aerodynamic efficiency losses. To minimize this, the gap at tips of the compressor blades is set so small that at certain conditions, the blade tips may rub against and engage an abradable seal on the casing of the gas turbine. The abradability of the seal material prevents damage to the blades while the seal material itself wears to generate an optimized mating surface and thus reduce the leakage of air.

Prior abradable seals have been made of a mixture of materials that produce an abradable seal having large pores. For example, the pores can have a size of 400 to 1800 microns. The large pores can cause leakage of air flow from the high pressure side of the tips of the compressor blades to the low pressure side, which can result in aerodynamic efficiency losses and an acoustic damping effect. Aerodynamic efficiency losses can also be caused by pressure fluctuations associated with air that flows into and out of the large pores of the abradable seal.

One prior abradable seal is formed of felt metal and includes large pores. However, this abradable seal can cause a 1% reduction in efficiency over an abradable seal with a hard smooth surface. Another prior abradable seal has filled porosity to increase efficiency. However, the hard and dense material of the seal requires that the tips of the compressor blades be tipped with hard or abrasive materials to improve the ability of the compressor blades to cut the seal material.

SUMMARY OF THE INVENTION

An abradable seal for a gas turbine engine includes a metal alloy and a plurality of pores in the metal alloy. The plurality of pores have a diameter of approximately 1 to 10 microns.

In another exemplary embodiment, a gas turbine engine includes a compressor to compress air. The compressor includes alternating rows of rotating compressor blades and static vanes. The gas turbine engine also includes a casing to house at least the compressor. An abradable seal is on an inner surface of the casing, and tips of the rotating compressor blades engage the abradable seal. The abradable seal includes a metal alloy and a plurality of pores in the metal alloy. The plurality of pores have a diameter of approximately 1 to 10 microns.

In another exemplary embodiment, a method of forming an abradable seal for a gas turbine engine includes the step of applying an abradable seal to a component of a gas turbine engine. The abradable seal includes a metal alloy and a plurality of pores in the metal alloy. The plurality of pores have a diameter of approximately 1 to 10 microns.

These and other features of the present invention can be best understood from the following specification and drawings, the following of which is a brief description.

DETAILED DESCRIPTION OF THE PREFERRED EMBODIMENT

Figure 1:
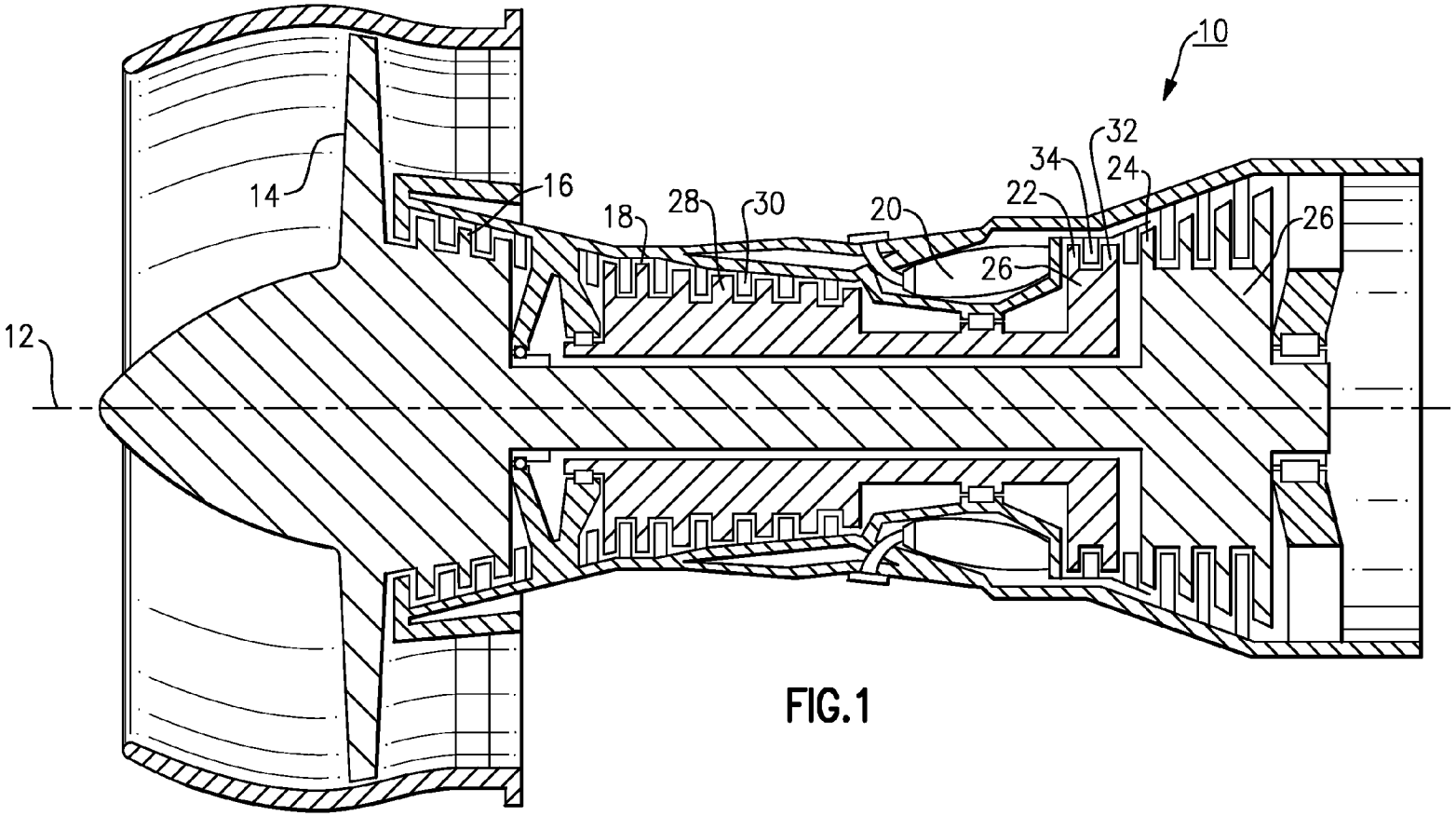
FIG. 1 illustrates a simplified cross-sectional view of a standard gas turbine engine.

As shown in FIG. 1, a gas turbine engine 10, such as a turbofan gas turbine engine, is circumferentially disposed about an engine centerline (or axial centerline axis 12). The gas turbine engine 10 includes a fan 14, compressors 16 and 18, a combustion section 20, and turbines 22 and 24. This application can extend to engines without a fan, and with more or fewer sections.

As is known, air is compressed in the compressors 16 and 18, mixed with fuel, burned in the combustion section 20, and expanded in the turbines 22 and 24. Rotors 26 rotate in response to the expansion, driving the compressors 16 and 18 and the fan 14. The compressors 16 and 18 include alternating rows of rotating compressor blades 28 and static airfoils or vanes 30. The turbines 22 and 24 include alternating rows of metal rotating airfoils or turbine blades 32 and static airfoils or vanes 34. The compressor blades 28 rotate in a casing 39 (shown in FIG. 2) and are closely spaced. It should be understood that this view is included simply to provide a basic understanding of the sections in a gas turbine engine 10 and not to limit the invention. This invention extends to all types of gas turbines for all types of applications, in addition to other types of turbines, such as vacuum pumps, air of gas compressors, booster pump applications, steam turbines, etc.

Figure 2:
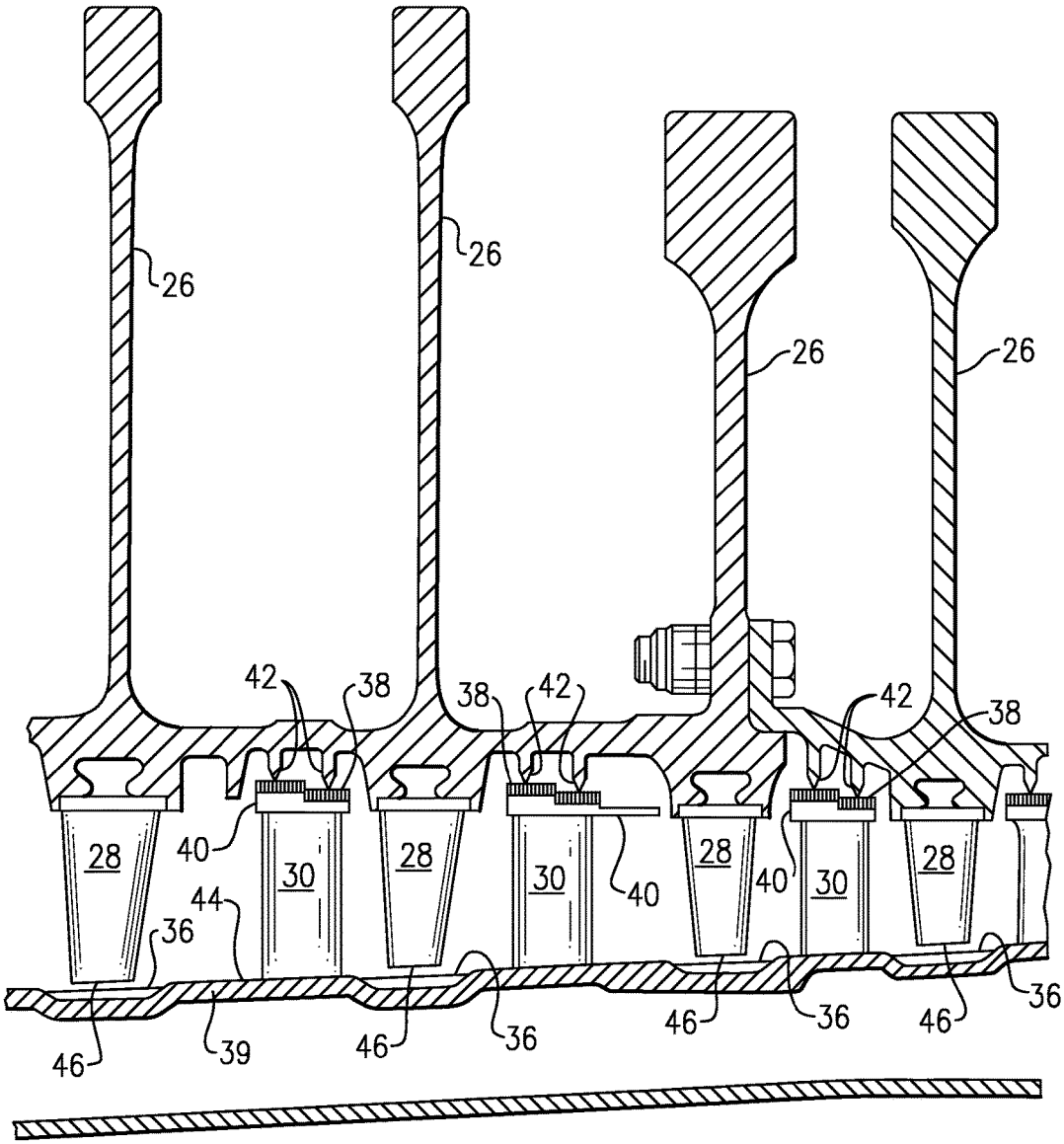
FIG. 2 illustrates a cross-sectional view of a portion of the gas turbine engine.

FIG. 2 shows a portion of the gas turbine engine 10. An abradable outer air seal 36 is located on an inner surface 44 of the casing 39 proximate to tips 46 of the compressor blades 28. In one example, the outer air seal 36 is a coating disposed as strips on the inner surface 44 of the casing 39 and located such that the tips 46 of the compressor blades 28 engage the strips of the outer air seal 36. Rotation of the compressor blades 28 wear away any portion of the outer air seal 36 which interfere with the tips 46 of the travel of the compressor blades 28. The outer air seal 36 is abradable to limit wear of the tips 46 of the compressor blades 28. Design of the coating properties is such that wear of non-tipped blade tips is limited to approximately that which is required to round up the blade assembly. The outer air seal 36 provides minimum leakage between the compressor blades 28 and the casing 39. The compressor blades 28 can be tipped or untipped.

An inner air seal 38 is attached on a free end 40 of the vanes 30, and the inner air seal 38 is closely spaced to a knife edge 42 mounted on extensions of the rotor 26. The knife edge 42 and the inner air seal 38 cooperate to reduce leakage and improve efficiency. The inner air seal 38 is also formed of an abradable coating that minimizes wear in this configuration of the knife edge 42 and reduces leakage of air. This configuration can also be used to prevent the leakage of oil. The prevention of leakage of oil becomes pertinent when an abradable seal is used in a bearing compartment where differential air pressure is used to prevent leakage of oil out of the bearing compartment. Although the outer air seal 36 will be described below, the properties and features of the outer air seal 36 also apply to the inner air seal 38. Further, the environment surrounding the seal is shown schematically and can be any other location for such a seal.

Figure 3:
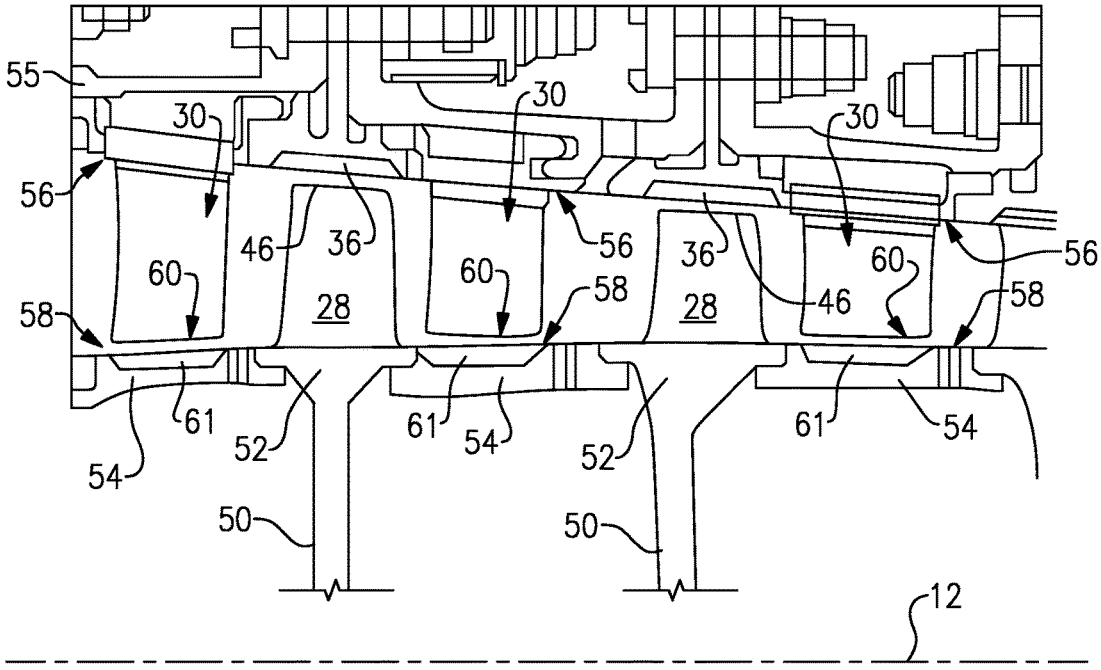
FIG. 3 illustrates a cross-sectional view of a portion of another embodiment of the gas turbine engine.

FIG. 3 illustrates another embodiment of a portion of the gas turbine engine 10 including vanes 30 and compressor blades 28. Multiple disks 50 rotate about the axis centerline axis 12 to rotate the compressor blades 28. Each disk 50 includes a disk rim 52, and each disk rim 52 supports a compressor blade 28. A rotor shaft 54 extends from each disk rim 52 between adjacent disk rims 52.

In one example, the vanes 30 are cantilevered vanes. That is, the vanes 30 are fixed to an engine casing or other structure 55 at a radial outward end 56 and are unsupported at a radial inward end 58. A tip 60 of the radial inward end 58 of each vane 30 extends adjacent to an inner air seal 61. The radial outward end 56 is mounted to the engine casing or other structure 55, which surrounds the compressors 16 and 18, the combustion section 20, and the turbines 22 and 24. The tip 60 of each vane 30 may contact the inner air seal 61 to limit re-circulation of airflow within the compressors 16 and 18. An abradable outer air seal 36 is located on the engine casing or other structure 55 proximate to tips 46 of the compressor blades 28. In this example, the knife edges have been eliminated as the vane 30 seals directly with the inner air seal 61 on the rotor shaft 54.

The outer air seal 36 provides improved aerodynamic efficiency and a lower density by including small pores within the microstructure of the outer air seal 36. For example, the pores of the outer air seal 36 can have an average pore size of approximately 1 to 10 microns and occupy approximately 50 to 70% of the space of the outer air seal 36. The volume fraction of pores can be determined to achieve the desired balance between abradability and erosion resistance. The outer air seal 36 has smaller pores within the microstructure of the outer air seal 36 than in conventional abradable materials. This improves the smoothness of the surface of the outer air seal 36 as manufactured, after rub of the compressor blades 28 against the outer air seal 36, and after erosion. The resulting pores have a size that can be one tenth the size of pores in prior outer air seals formed by conventional processes.

The pores are small enough to provide resistance to air flow through the outer air seal 36 on the order of 10,000,000 rayls/m. By increasing flow resistivity, acoustic pressure wave energy is reflected back into the gas stream. The outer air seal 36 also decreases aerodynamic losses in the compressors 16 and 18.

The outer air seal 36 is formed of MCrAlY. The metal (M) can be nickel or cobalt, and the alloying elements are chromium (Cr), aluminum (Al) and yttrium (Y). In one example, the outer air seal 36 is formed of approximately 36% cobalt, 32% nickel, 21% chromium, 8% aluminum and 0.4% yttrium.

Example compositions of MCrAlY are listed in the below chart:

SUITABLE MATRIX MATERIALS

| | Alloy 1 | | Alloy 2 | | Alloy 3 | |
|---|---|---|---|---|---|---|
| | min | max | min | max | min | max |
| Chromium | 5.0 | 18.0 | 24.00 | 26.00 | 15.00 | 19.00 |
| Aluminum | 3.0 | 8.0 | 5.50 | 6.50 | 11.80 | 13.20 |
| Hafnium | 0.1 | 1.0 | 0.50 | 1.50 | 0.10 | 0.40 |
| Yttrium | 0.001 | 0.09 | 0.05 | 0.15 | 0.40 | 0.80 |
| Titanium | 0 | 5.0 | — | — | — | — |
| Cobalt | 0 | 20.0 | — | — | 20.00 | 24.00 |
| Tungsten | 0 | 15.0 | 7.50 | 8.50 | — | — |
| Molybdenum | 0 | 4.0 | — | — | — | — |
| Tantalum | 0 | 12.0 | 3.50 | 4.50 | — | — |
| Zirconium | 0 | 0.2 | — | — | — | — |
| Boron | 0 | 0.2 | — | — | — | — |

-continued

SUITABLE MATRIX MATERIALS

| | Alloy 1 | | Alloy 2 | | Alloy 3 | |
|---|---|---|---|---|---|---|
| | min | max | min | max | min | max |
| Carbon | 0 | 0.2 | 0.20 | 0.25 | — | 0.02 |
| Silicon | — | — | — | — | 0.20 | 0.60 |
| Rhenium | 0 | 7.0 | — | — | — | — |
| Columbium | 0 | 5.0 | — | — | — | — |
| Iron | — | 0.2 | — | — | — | — |
| Copper | — | 0.1 | — | — | — | — |
| Phosphorous | — | 0.01 | — | 0.01 | — | 0.010 |
| Sulfur | — | 0.01 | — | 0.01 | — | 0.010 |
| Lead | — | 0.005 | — | — | — | 0.0025 |
| Bismuth | — | 0.001 | — | — | — | 0.0001 |
| Manganese | — | 0.05 | — | — | — | — |
| Nickel + Trace | Remainder | | Remainder | | Remainder | |

Prior to application of the outer air seal 36 to the inner surface 44 of the casing 39 of the gas turbine engine 10, the MCrAlY is mixed with a low density fugitive filler that is used to form the small pores in the outer air seal 36. In one example, the fugitive filler can be polymethylmethacrylate, polyester, or polyvinyl alcohol (PVA).

The fugitive material can be any of the materials that can be removed from the matrix after coating deposition by pyrolysis, vaporization or dissolution. Example fugitive materials include graphite and organic solids that will burn away when heated in air and polymers that will dissolve in organic solvents.

Prior to forming the outer air seal 36, the MCrAlY is refined to have a particle size of from 1 to 25 microns, and the fugitive filler is refined to have a particle size of 0.5 to 25 microns, more specifically 1 to 10 microns. The MCrAlY and the fugitive filler particles can be classified from existing feed stock materials, specially manufactured to have the desired particle size or refined by machinery, such as cryogenic ball milling to achieve the desired particle size. As these particles are smaller than the particles used to form the abradable seals of the prior art, the pores in the outer air seal 36 are smaller than the pores in the abradable seals of the prior art. When the MCrAlY and the fugitive filler are mixed and applied to the inner surface 44 of the casing 39, approximately 30 to 50% of the outer air seal 36 is formed of MCrAlY, and the remainder of the outer air seal 36 (approximately 50 to 70%) is the fugitive filler (that will melt or burn away to define the pores). To facilitate efficient manufacturing of the coating, the fine particles may be agglomerated by spray drying a slurry of a binder phase and the metal and fugitive particles to form agglomerates that flow well through conventional spray processing equipment. The binder phase is ideally polyvinyl alcohol or an acrylic emulsion.

The outer air seal 36 can be produced by a variety of methods. In a first method, the outer air seal 36 is produced by employing a thermal spray coating process. As stated above, the MCrAlY and the fugitive filler are processed by a machine to reduce the particle size. The fine powder of MCrAlY and the fine powder of the fugitive filler are applied to the inner surface 44 of the casing 39 of the gas turbine engine 10 through a spray process.

In one example, the fine powder of MCrAlY and the fine powder of the fugitive filler are applied simultaneously to the inner surface 44 of the casing 39. In another example, the fine powder of MCrAlY is in a suspension and sprayed. In another example, solution precursor plasma spraying can be employed using a liquid precursor, and the feedstock solution is heated prior to application to the casing 39. In one example, the fine powder of MCrAlY and the fine powder of fugitive filler are mixed and agglomerated, and the fine particles are glued together forming mixed agglomerate particles. The agglomerates exhibit improved flowability through conventional thermal spray powder feed equipment and lend themselves to processing into a coating with conventional thermal spray processes.

Inert gas shrouding or a protective atmosphere (such as a low pressure plasma spray) can be employed, if desired, to reduce oxidation of the particles and improve inter-particle bonding. These methods may be desired due to the low mass and high surface area of the small particles.

Once applied, the powders are heated to burn and remove the fugitive filler, creating pores in the MCrAlY microstructure where the fugitive filler existed and forming the outer air seal 36. In one example, the powders are heated to a temperature between 400 and 900° F. (204.44 and 482.22° C.).

In another method, the outer air seal 36 is a metallic foam. A metallic foam is a solid metal including gas-filled pores. The metallic foam is formed without the fugitive filler. The pores can be formed by injecting gas into molten MCrAlY. In one example, the gas is argon. The pores can also be formed by adding hollow spheres to the MCrAlY to form pores. However, any method of incorporating porosity into the MCrAlY can be employed. The outer air seal 36 has a sponge like structure and is attached to the inner surface 44 of the casing 39 of the gas turbine engine 10.

Powder metallurgy can also be employed to form the outer air seal 36. In a powder metallurgy process, the MCrAlY and the fugitive filler are formed into fine particles by ball-milling. The fine particles are placed in a solvent or water to form a slurry or solution. The fine particles are then injected into a mold or passed through a die to form a structure having the shape and size of the finished outer air seal 36. The outer air seal 36 is formed by applying pressure and subjecting the outer air seal 36 to high temperatures to dry the slurry and fuse the particles together. In one example, the outer air seal 36 is subjected to a pressure of 2,000 pounds per square inch (136 dynes per square centimeter) and temperatures of 1975° F. (1079° C.). The outer air seal 36 can then be attached to the inner surface 44 of the casing 39, for example by brazing.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. An abradable seal for a gas turbine engine comprising:

a metal alloy, wherein the metal alloy is MCrAlY, and M is a metal, Cr is chromium, Al is aluminum and Y is yttrium; and a plurality of pores in the metal alloy, wherein the plurality of pores have a diameter of approximately 1 to 10 microns.

2. The abradable seal as recited in claim 1 wherein approximately 30 to 50% of an abradable seal is the metal alloy and approximately 50 to 70% of the abradable seal is the plurality of pores.

3. The abradable seal as recited in claim 1 wherein the metal is one of nickel and cobalt.

4. The abradable seal as recited in claim 1 wherein a fugitive filler is mixed with the metal alloy, and the fugitive filler is burned away to form the plurality of pores.

5. The abradable seal as recited in claim 4 wherein the fugitive filler is one of polymethylmethacrylate, polyester, and polyvinyl chloride.

6. The abradable seal as recited in claim 4 wherein the metal alloy is refined to a size of 1 to 25 microns and the fugitive filler is refined to a size of 0.5 to 25 microns prior to formation of an abradable seal.

7. The abradable seal as recited in claim 1 wherein the metal alloy and a fugitive filler are applied simultaneously to the component of the gas turbine engine.

8. A gas turbine engine comprising:

a compressor to compress air, wherein the compressor includes alternating rows of rotating compressor blades and static vanes;

a casing to house at least the compressor; and an abradable seal on an inner surface of the casing, wherein tips of the rotating compressor blades engage the abradable seal, the abradable seal includes a metal alloy and a plurality of pores in the metal alloy, the metal alloy is MCrAlY, M is a metal, Cr is chromium, Al is aluminum and Y is yttrium, and the plurality of pores have a diameter of approximately 1to 10 microns.

9. The gas turbine engine as recited in claim 8 wherein a fugitive filler is mixed with the metal alloy, and the fugitive filler is burned away to form the plurality of pores, and the fugitive filler is one of polymethylmethacrylate, polyester, and polyvinyl chloride.

10. The gas turbine engine as recited in claim 9 wherein the metal alloy is refined to a size of 1 to 25 microns and the fugitive filler is refined to a size of 0.5 to 25 microns prior to formation of an abradable seal.

11. The gas turbine engine as recited in claim 8 including an abradable inner air seal on a free end of the plurality of static vanes.

12. The gas turbine engine as recited in claim 11 including a projection on a rotor shaft that engages the abradable inner air seal.

13. A method of forming an abradable seal for a gas turbine engine, the method comprising the steps of:

applying an abradable seal to a component of a gas turbine engine, wherein the abradable seal includes a metal alloy and a plurality of pores in the metal alloy, wherein the plurality of pores have a diameter of approximately 1 to 10 microns, the metal alloy is MCrAlY, and M is a metal, Cr is chromium, Al is aluminum and Y is yttrium.

14. The method as recited in claim 13 wherein the abradable seal is applied by thermal spraying.

15. The method as recited in claim 14 including the step of adding a fugitive filler to the metal alloy.

16. The method as recited in claim 15 wherein the abradable seal is heated to a temperature between 400 and 900° F. to melt and burn away the fugitive filler to form the plurality of pores in the metal alloy.

17. The method as recited in claim 15 including the step of machining the metal alloy and the fugitive filler prior to the step of applying to reduce a particle size.

18. The method as recited in claim 15 including a step of refining the metal alloy to have a particle size of 1 to 25 microns and a step of refining the fugitive filler to have a particle size of 0.5 to 25 microns before the step of applying the abradable seal.

19. The method as recited in claim 13 wherein the abradable seal is applied by a foaming metal process.

20. The method as recited in claim 13 wherein the abradable seal is applied by a powder metallurgy process.

* * * * *